US008608494B2

(12) United States Patent
Yang

(10) Patent No.: US 8,608,494 B2
(45) Date of Patent: Dec. 17, 2013

(54) SOCKET FOR MICRO SUBSCRIBER IDENTIFICATION MODULE CARD

(75) Inventor: In-Chol Yang, Ansan (KR)

(73) Assignee: Molex Incorporated, Lisle, IL (US)

( * ) Notice: Subject to any disclaimer, the term of this patent is extended or adjusted under 35 U.S.C. 154(b) by 76 days.

(21) Appl. No.: 13/432,631

(22) Filed: Mar. 28, 2012

(65) Prior Publication Data

US 2012/0252240 A1 Oct. 4, 2012

(30) Foreign Application Priority Data

Mar. 28, 2011 (KR) ..... 10-2011-0027436

(51) Int. Cl.
*H01R 13/62* (2006.01)

(52) U.S. Cl.
USPC ..... 439/159; 439/188

(58) Field of Classification Search
USPC ..... 439/159, 630
See application file for complete search history.

(56) References Cited

U.S. PATENT DOCUMENTS

| | | | | |
|---|---|---|---|---|
| 5,836,775 | A * | 11/1998 | Hiyama et al. | 439/159 |
| 6,394,827 | B2 * | 5/2002 | Nogami | 439/159 |
| 6,478,595 | B2 * | 11/2002 | Nishioka | 439/188 |
| 6,648,694 | B2 * | 11/2003 | Takamori et al. | 439/630 |
| 6,655,973 | B2 * | 12/2003 | Ji et al. | 439/159 |
| 6,767,232 | B1 * | 7/2004 | Tien | 439/159 |
| 6,793,511 | B2 * | 9/2004 | Murayama et al. | 439/188 |
| 6,846,192 | B2 * | 1/2005 | Tien | 439/159 |
| 6,908,322 | B1 * | 6/2005 | Bricaud et al. | 439/152 |
| 7,118,395 | B2 * | 10/2006 | Tsuji | 439/159 |
| 7,207,814 | B2 * | 4/2007 | Chen et al. | 439/159 |
| 7,309,245 | B2 * | 12/2007 | Sadatoku | 439/159 |
| 7,364,820 | B2 * | 4/2008 | Tanaka et al. | 439/633 |
| 7,381,094 | B2 * | 6/2008 | Miyao et al. | 439/630 |
| 7,410,375 | B2 * | 8/2008 | Van der Steen et al. | 439/159 |
| 7,416,427 | B2 * | 8/2008 | Ting | 439/159 |
| 7,473,115 | B2 * | 1/2009 | Yu et al. | 439/188 |
| 7,578,686 | B2 * | 8/2009 | Yu et al. | 439/188 |
| 7,637,759 | B2 * | 12/2009 | Kobayashi et al. | 439/159 |
| 7,837,488 | B2 * | 11/2010 | Wu | 439/188 |
| 7,891,997 | B2 * | 2/2011 | Hirayama | 439/159 |
| 7,927,115 | B2 * | 4/2011 | Sun | 439/159 |
| 7,988,471 | B2 * | 8/2011 | Matsumoto et al. | 439/159 |
| 7,988,473 | B2 * | 8/2011 | Tsai | 439/159 |
| 8,337,223 | B2 * | 12/2012 | Gao et al. | 439/159 |
| 8,393,910 | B2 * | 3/2013 | Matsumoto et al. | 439/159 |
| 2002/0008142 | A1 * | 1/2002 | Takayasu et al. | 235/441 |
| 2012/0083145 | A1 * | 4/2012 | Gao et al. | 439/155 |
| 2012/0238114 | A1 * | 9/2012 | Kobayashi et al. | 439/159 |

* cited by examiner

*Primary Examiner* — Amy Cohen Johnson
*Assistant Examiner* — Vladimir Imas
(74) *Attorney, Agent, or Firm* — Timothy M. Morella

(57) ABSTRACT

A micro SIM card socket is equipped with an insulator housing, wherein the SIM card is installed; a metal shell, connected to the housing at a constant distance from the housing, that guides the insertion of the SIM card; multiple contact terminals, supported by the housing, one end of which is connected to the contact terminal of the SIM card and the other end of which is fixed to the printed circuit board; a locking unit installed on the side of the housing in order to selectively fix the insertion point of the SIM card, having a curve-shaped pressure pin, at the end of the unit, putting pressure to the edge of the SIM card; a detect terminal installed in the housing in order to detect the insertion of the SIM card and that is pressured by the pressure pin, located in proximity of the pressure pin, when the SIM card is inserted; and a switch terminal that elastically contacts the detect terminal.

6 Claims, 8 Drawing Sheets

SOCKET FOR MICRO SUBSCRIBER IDENTIFICATION MODULE CARD

REFERENCE TO RELATED APPLICATIONS

The Present Disclosure claims priority to prior-filed Korean Patent Application No. 10-2011-0027436, entitled "Socket For Micro Subscriber Identification Module Card," filed on 28 Mar. 2011 with the Korean Intellectual Property Office. The content of the aforementioned Patent Application is fully incorporated in its entirety herein.

BACKGROUND OF THE PRESENT DISCLOSURE

The Present Disclosure relates, generally, to a micro Subscriber Identification Module (SIM) card socket, and, to be more specific, a micro SIM card socket with an improved structure in which a detect terminal in the mechanism that senses the insertion of a SIM card touches the SIM card indirectly, not directly. Therefore it, though detecting the insertion of a SIM card, prevents the SIM card, in a locked state, from being pushed to the opposite side of the direction of the insertion.

In general, a SIM card is a chip containing a variety of personal information of the subscriber, such as a telephone directory, and makes it possible to freely use one's mobile phone in any area once it is connected to an international roaming terminal, regardless of the technical specification, such as CMDA or GSM. For international roaming service, using a SIM card, the SIM card is directly inserted into a socket installed on the inside of the terminal (mobile phone).

FIG. 1 is an exploded oblique view showing a conventional micro SIM card socket, and FIGS. 2-4 illustrate the operation of a conventional micro SIM card socket. Referring to FIGS. 1-4, a conventional micro SIM card socket 10 is equipped with an insulator housing 11 in which the SIM card 1 is installed; a metal shell 12, connected to the housing 11 at a constant distance from the housing 11 that guides the insertion of the above mentioned SIM card 1; multiple contact terminals 13, supported by the housing 11, one end of which is connected to the contact terminal 1*a* of the SIM card 1 and the other end of which is fixed to the printed circuit board; a locking unit 14 installed on the side of the housing 11 in order to selectively fix the insertion point of the SIM card 1; a detect terminal 15 supported on the housing 11 and directly contacting the edge of the SIM card 1 in order to detect the insertion of the SIM card 1; and a switch terminal 16 that contacts the detect terminal 14.

In a conventional micro SIM card socket 10, as shown above, the locking unit 14 prevents the SIM card 1 from slipping out when a SIM card is inserted into the housing 11. At that time, one side of the contact terminal 13 contacts the contact terminal 1*a* of the SIM card 1, and the detect terminal 15 is directly and elastically pushed to the edge of the SIM card 1 and elastically contacts the switch terminal 16, and insertion of the SIM card 1 into the housing 11 is detected.

However, the conventional micro SIM card socket has a problem in that the SIM card can be easily slipped out of the housing by a small external impact, despite of the locking by the locking unit, because the SIM card detect terminal is constantly subject to a force that pushes the SIM card, inserted in the housing, to the opposite direction of the insertion into the housing.

SUMMARY OF THE PRESENT DISCLOSURE

A purpose of the Present Disclosure is to provide a micro SIM card socket where the detect terminal in the structure detecting the insertion of a SIM card touches the SIM card indirectly, not directly. Therefore, the SIM card in a locked state is not subject to a force to the opposite direction of the insertion, thereby raising the product reliability.

In order to achieve the above mentioned purposes, the micro SIM card socket in the Present Disclosure is equipped with an insulator housing where the SIM card is installed; a metal shell, connected to the housing at a constant distance from the housing, that guides the insertion of the SIM card; multiple contact terminals, supported by the housing, one end of which is connected to the contact terminal of the SIM card and the other end of which is fixed to the printed circuit board; a locking unit installed on the side of the housing in order to selectively fix the insertion point of the SIM card, having a curve-shaped pressure pin, at the end of the unit, putting pressure to the edge of the SIM card; a detect terminal installed in the housing in order to detect the insertion of the SIM card and that is pressured by the pressure pin, located in proximity of the pressure pin, when the SIM card is inserted; and a switch terminal that elastically contacts the detect terminal.

The SIM card, when inserted, is neither pushed nor displaced out of the above mentioned housing by an external vibration or an impact because the detect terminal puts pressure only to the cam of the locking unit. Further, the cam of the locking unit is elastically fixed by a pin rod when the SIM card is inserted into the inside of the housing.

Thus, in the Present Disclosure, the detect terminal in the structure detecting the insertion of a SIM card touches the SIM card indirectly, not directly. Therefore, the SIM card in a locked state is not subject to a force to the opposite direction of the insertion. Further, while the insertion of a SIM card is effectively detected, the SIM card, micro SIM card in particular, does not slip out easily by an external vibration or an impact, thereby raising the product reliability.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
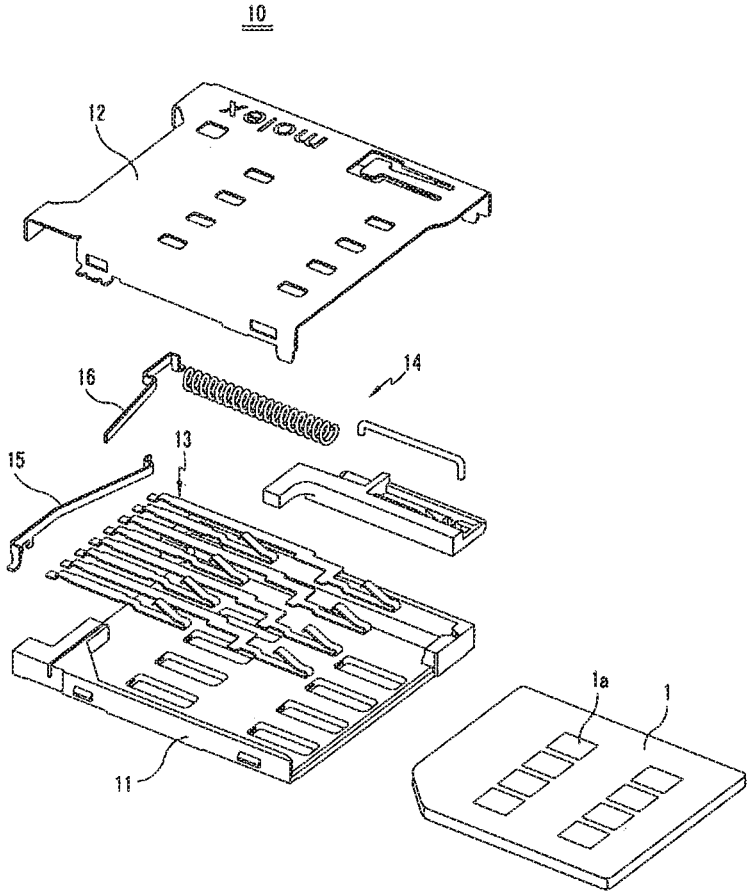
FIG. 1 Prior Art
FIG. 1 is an exploded oblique view of a conventional micro SIM card socket.
Figure 2:
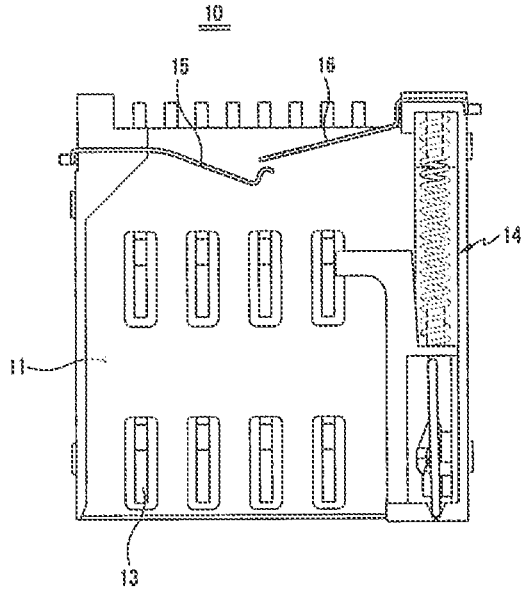
FIG. 2 Prior Art
FIGS. 2-4 illustrate the operation of the conventional micro SIM card socket of FIG. 1.

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

With reference to FIGS. 5-10, a micro SIM card socket 100 in conformity with the first embodiment of the Present Disclosure is equipped with an insulator housing 110 where the SIM card 1 is installed; a metal shell 120, connected to the housing 110 at a constant distance from the housing 110, that guides the insertion of the SIM card 1; multiple contact terminals 130, supported by the housing 110, one end of which is connected to the contact terminal (not shown) of the SIM card 1 and the other end of which is fixed to the printed circuit board (not shown); a locking unit 140 elastically installed on the side of the housing 140*a* in order to selectively fix the insertion point of the SIM card 1, having a curve-shaped pressure pin 140*a*, at the end of the unit, putting pressure to the edge of the SIM card 1; a detect terminal 150 installed in the housing 110, in order to detect the insertion of the SIM card 1, and pressured by the pressure pin 140*a*, located in proximity of the pressure pin 140*a*, when the SIM card 1 is inserted; and a switch terminal 160 that elastically contacts the detect terminal 150.

The housing 110 preferably consists of such insulators, and has multiple grooves 111 at the bottom to prevent the interference with the contact terminals. The metal shell 120 guides the insertion of the SIM card 1 and is preferably made of metal. The contact terminal 130 electrically connects the SIM card 1 with the printed circuit board, and eight contact terminals 130 are consecutively laid out.

The locking unit 140 is installed in such a way that it can slide with the SIM card 1 inside the side of the housing 110, and is equipped with a heart cam 141 with a guide groove 141*a* in the shape of a heart; a pin rod 143, the edge of which is inserted into the guide groove 141*a* and fixes the position of the micro SIM card while moving along the guide groove 141*a*; and a spring 145 that elastically supports the heart cam 141.

The detect terminal 150 and the switch terminal (160) are installed, in parallel, in the housing 110 in order to detect the insertion of the SIM card 1. When the detect terminal 150 is away from the switch terminal 160, it is detected that the SIM card 1 is not inserted into the housing 110. When the detect terminal 150 contacts the above mentioned switch terminal 160, it is detected that the SIM card 1 is inserted into the housing 110.

The detect terminal 150 is laid out in such a way that it is positioned in proximity to the pressure pin 140*a* and is elastically pushed when the SIM card 1 is inserted into the housing 110, and the switch terminal 160 elastically contacts the detect terminal 150. The detect terminal 150 is laid out in such a way that it puts pressure only to the cam 141 of the locking unit 140, when the SIM card 1 is inserted, and it prevents the SIM card 1, micro SIM card in particular, from being pushed or displaced out of the housing 110 by an external vibration or an impact. When the SIM card 1 is inserted into the housing 110, the cam 141 of the locking unit 140 is elastically fixed by the pin rod 143.

The operation of a micro SIM card socket 100, laid out as described above, is explained as follows. Micro SIM card 1 is pushed into an insulator housing 110. At this time, the metal shell 120 plays a role of guiding the insertion of the micro SIM card 1. And the heart cam 141 is elastically supported by the spring 145, and the end edge of the pin rods 143 is consecutively positioned along the guide groove 141*a*, changing the SIM card 1 from a separated position to an inserted position. When the insertion of the micro SIM card is completed, the end edge of the SIM card 1 presses the pressure pin 140*a*, and the detect terminal 150 is elastically deformed by the pressure pin 140*a* and elastically touches the switch terminal 160, detecting the insertion of the SIM card 1.

In the Present Disclosure 100, the detect terminal 150 in the structure detecting the insertion of a SIM card 1 touches the SIM card 1 indirectly, not directly. Therefore, the SIM card 1, in a locked state, is not subject to a force to the opposite direction of the insertion. Thus, while the insertion of a SIM card 1 is effectively detected, the SIM card, micro SIM card in particular, does not slip out easily by an external vibration or an impact, thereby raising the product reliability.

Figure 3:
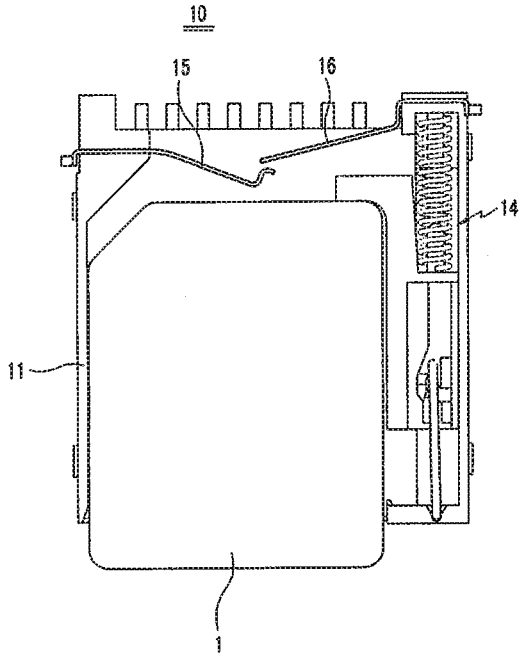
FIG. 3 Prior Art
Figure 4:
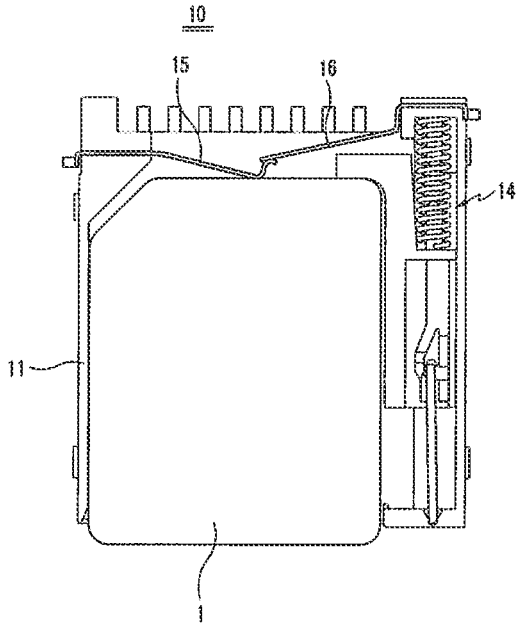
FIG. 4 Prior Art
Figure 5:
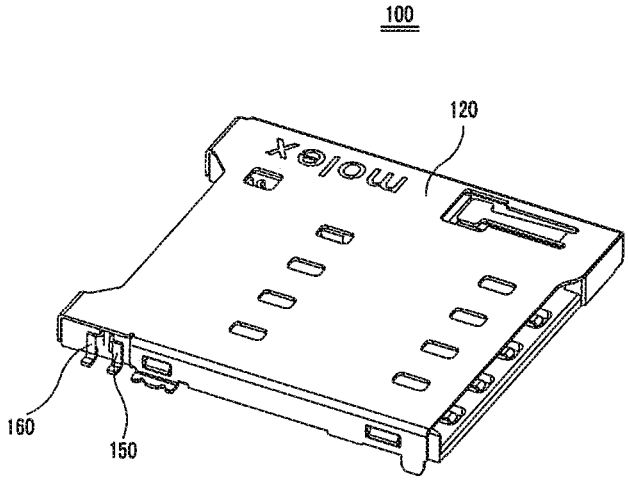
FIG. 5 is an oblique view of a micro SIM card socket of the Present Disclosure.
Figure 6:
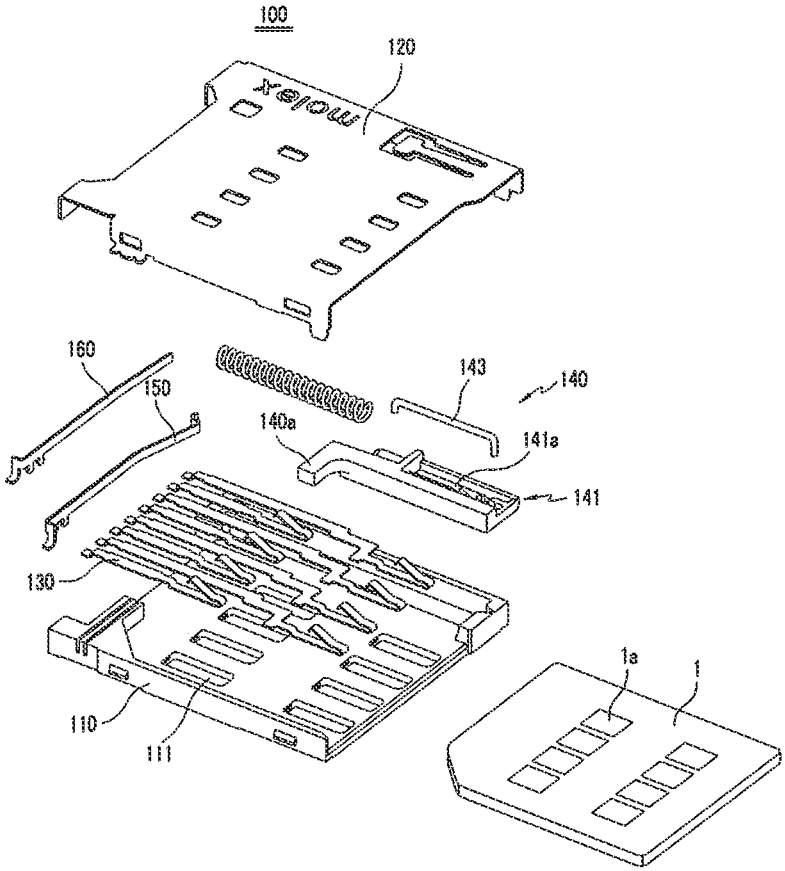
FIG. 6 is an exploded oblique view of the micro SIM card socket of FIG. 5.
Figure 7:
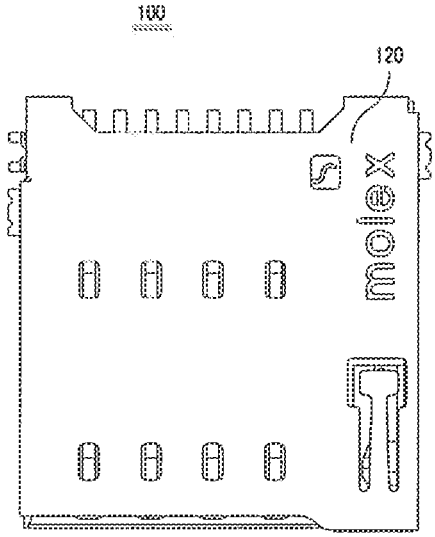
FIG. 7 is a plane view showing the micro SIM card socket of FIG. 5.
Figure 8:
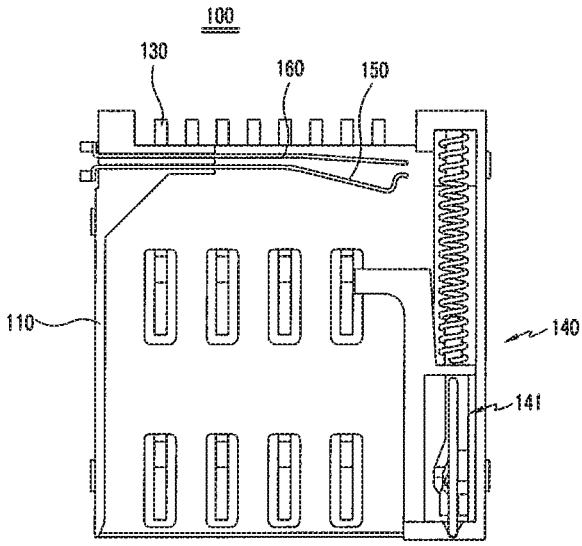
FIGS. 8-10 illustrate the operation of the micro SIM card socket of FIG. 5.
Figure 9:
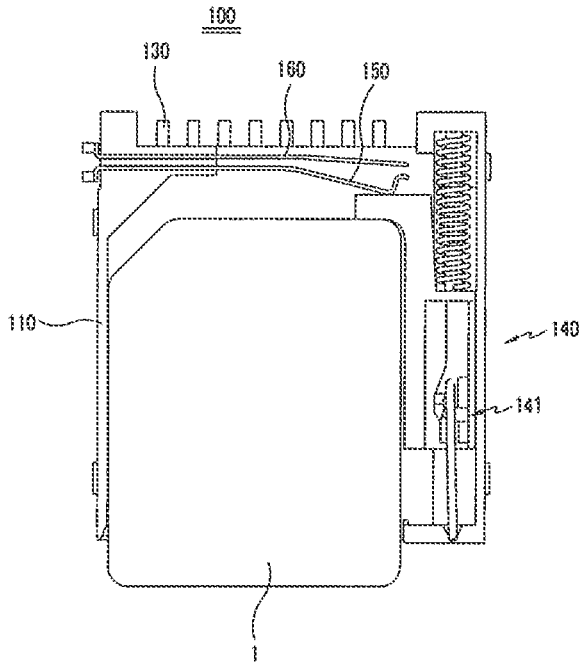
Figure 10:
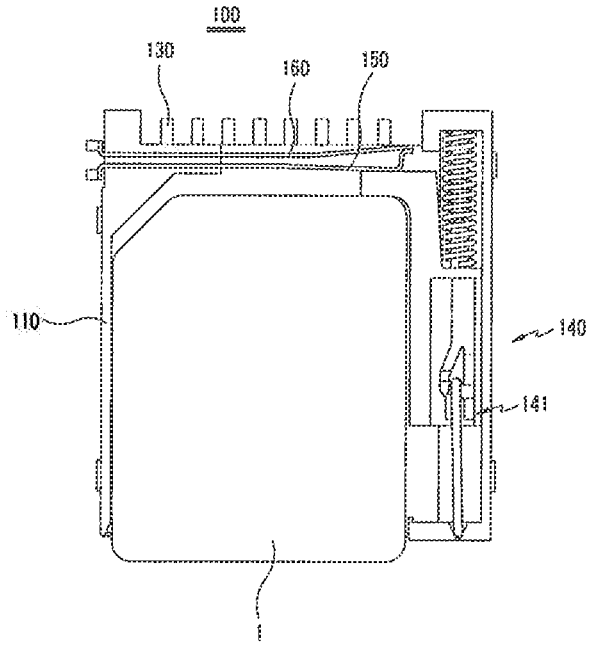
Figure 11:
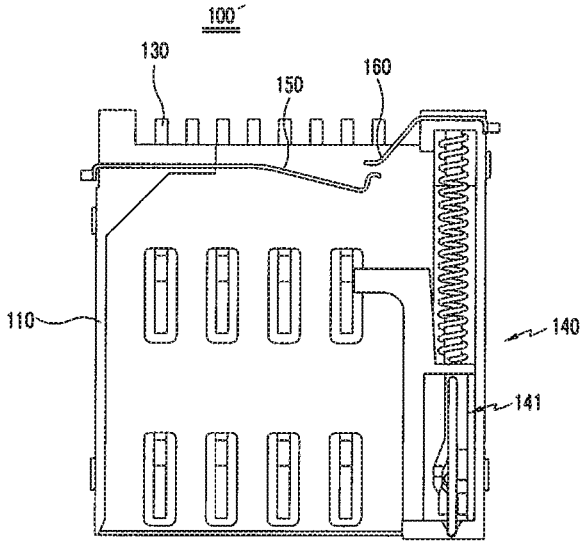
FIGS. 11-13 illustrate the operation of a micro SIM card socket of the Present Disclosure.
Figure 12:
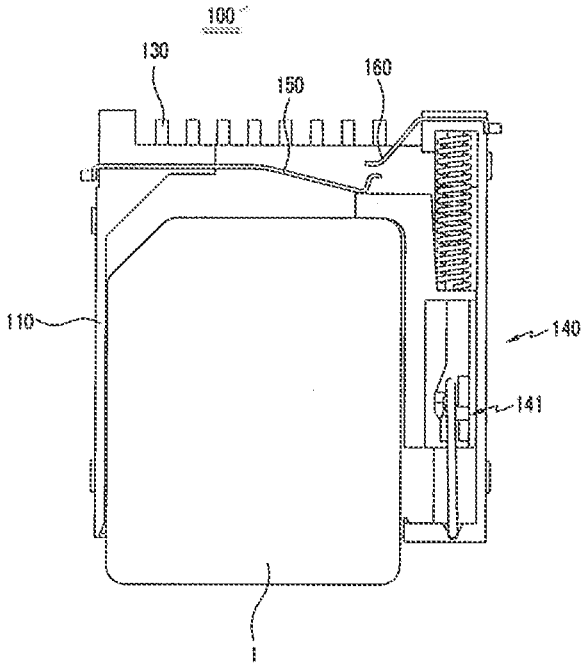
Figure 13:
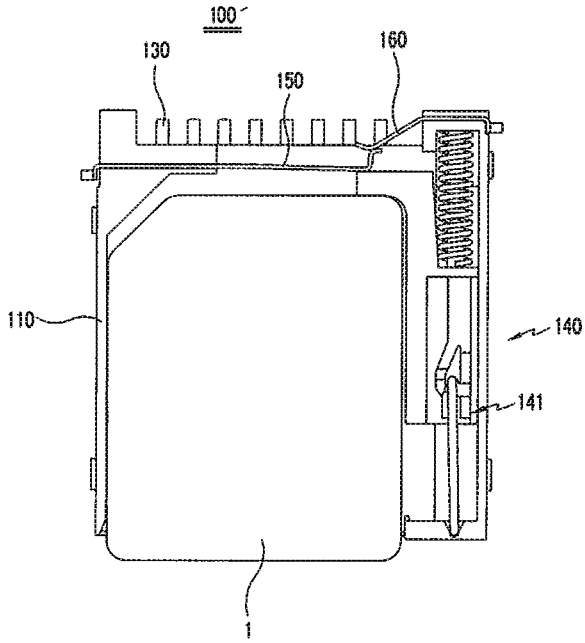

FIGS. 11-3 illustrate the operation of the micro SIM card socket in conformity with a second embodiment of the Present Disclosure. Referring to FIGS. 11-3, the micro SIM card socket 100' is identical to the micro SIM card socket 100 of the first embodiment, except that the detect terminal 150 and the switch terminal 160 are laid out in such a structure that they face each other. To the extent possible, this description uses, for the sake of convenience, the same diagram symbols.

As explained above, the detect terminal 150 and the switch terminal 160 are laid out in such a way that when they are away from each other, it is detected that the SIM card 1 has not been inserted into the housing 110, and when the detect terminal 150 and the switch terminal 160 touch each other, it is detected that the SIM card 1 has been inserted into the housing 110. And the detect terminal 150 is laid out in such a way that it is made relatively longer than the switch terminal 160, positioning the contact points to one side of the housing 110. The detect terminal 150 is laid out in such a way that it is positioned in proximity of the pressure pin 140*a* and is elastically pushed when the SIM card 1 is inserted into the housing 110, and the switch terminal 160 elastically contacts the detect terminal 150.

The operation of a micro SIM card socket 100' according to the second embodiment is explained as follows. Micro SIM card 1 is pushed into an insulator housing 110. At this time, the metal shell 120 plays a role of guiding the insertion of the micro SIM card 1. And the heart cam 141 is elastically supported by the spring 145, and the end edge of the pin rods 143 is consecutively positioned along the guide groove 141*a*, changing the SIM card 1 from a separated position to an inserted position. When the insertion of the above micro SIM card 1 completes, the end edge of the SIM card 1 presses the pressure pin 140*a*, and the detect terminal 150 is elastically deformed by the pressure pin 140*a* and elastically touches the switch terminal 160, detecting the insertion of the SIM card 1.

As explained above, the detect terminal in the structure detecting the insertion of a SIM card touches the SIM card indirectly, not directly. Therefore, the SIM card in a locked state is not subject to a force to the opposite direction of the insertion. Further, while the insertion of a SIM card is effectively detected, the SIM card, micro SIM card in particular, does not slip out easily by an external vibration or an impact, thereby raising the product reliability.

While a preferred embodiment of the Present Disclosure is shown and described, it is envisioned that those skilled in the art may devise various modifications without departing from the spirit and scope of the foregoing Description and the appended Claims.

What is claimed is:

1. A micro SIM card socket, the micro SIM card socket comprising:

an insulator housing, in which the SIM card is installed;

a metal shell, the metal shell being connected to the housing at a constant distance from the housing, the metal shell adapted to guide the insertion of the SIM card;

multiple contact terminals, each contact terminal being supported by the housing, one end of each contact terminal being connected to the contact terminal of the SIM card and the other end being fixed to the printed circuit board;

a locking unit, the locking unit being elastically installed on a side of the housing in order to selectively fix the insertion point of the SIM card and having a curve-shaped pressure pin, at the end of the locking unit, for putting pressure to the edge of the SIM card;

a detect terminal, the detect terminal being installed in the housing in order to detect the insertion of the SIM card and pressured by the pressure pin, located in proximity of the pressure pin, when the SIM card is inserted; and a switch terminal, the switch terminal being installed in the housing and adapted to elastically contact the detect terminal;

wherein the detect terminal is pushed by the pressure pin and contacts the switch terminal when the SIM card is inserted.

2. The micro SIM card socket of claim 1, wherein, when the SIM card is inserted, the detect terminal applies pressure only on the cam of the locking unit.

3. The micro SIM card socket of claim 2, wherein, when the SIM card is inserted into the housing, the cam of the locking unit is elastically fixated by the pin rod.

4. The micro SIM card socket of claim 1, wherein, when the SIM card is inserted into the housing, the cam of the locking unit is elastically fixated by the pin rod.

5. The micro SIM card socket of claim 1, wherein the detect terminal and the switch terminal are positioned in parallel.

6. The micro SIM card socket of claim 1, wherein the detect terminal and the switch terminal are positioned in such a way that they face each other.

* * * * *